United States Patent [19]

Inoue

[11] Patent Number: 4,488,606

[45] Date of Patent: Dec. 18, 1984

[54] METHOD OF EXCAVATING AN UNDER-REAMED PILE BORE

[76] Inventor: Hachiro Inoue, 13-10, Kokubu 4-chome, Ichikawa-shi, Chiba-ken, Japan

[21] Appl. No.: 481,152

[22] Filed: Apr. 1, 1983

Related U.S. Application Data

[63] Continuation of Ser. No. 257,906, Apr. 27, 1981, Pat. No. 4,396,026.

[51] Int. Cl.[3] ..... E21B 10/32; E21B 10/30

[52] U.S. Cl. ..... 175/57; 175/265; 175/285; 175/325; 405/237

[58] Field of Search ..... 175/57, 265, 285, 290, 175/322, 325, 363, 366, 367, 368, 369; 405/237, 238

[56] References Cited

U.S. PATENT DOCUMENTS 3,112,802 12/1963 Amann et al. ..... 175/285
3,938,598 2/1976 Watts ..... 175/99
4,046,205 9/1977 Asayama ..... 405/244
4,193,462 3/1980 Blaschke et al. ..... 175/394

*Primary Examiner*—Stephen J. Novosad
*Assistant Examiner*—William P. Neuder
*Attorney, Agent, or Firm*—Lowe King Price & Becker

[57] ABSTRACT

An under-reaming pile bore excavator by which a straight pile bore is first excavated vertically to a given depth by rotating the main drill bits and the under-reamed bore is next excavated downward and outward into a given shape by rotating the slidable wing bits. The under-reaming pile bore excavator of the present invention comprises a plurality of guide rails, and a plurality of slidable wing bits mounted on the guide rails which excavate the under-reamed bore, in addition to the conventional main drill bits which excavate the straight pile bore. In using the under-reaming pile bore excavator of the present invention, it is possible to obtain a stable impermeable soil surface on the excavated bore to prevent water from penetrating into the soil wall and to prevent lumps of soil from being dislodged therefrom.

3 Claims, 19 Drawing Figures

SLIDABLE BIT EXCAVATION

METHOD OF EXCAVATING AN UNDER-REAMED PILE BORE

This is a continuation of application Ser. No. 257,906, filed 4/27/81, now U.S. Pat. No. 4,396,026.

BACKGROUND OF THE INVENTION

1. Field of the Invention

The present invention relates generally to an under-reaming pile bore excavator and the method of its operation, and more particularly to an excavator such that an under-reamed part of a pile bore is excavated using a plurality of slidable wing bits moving downward and extending outward at the bottom of a straight pile bore along a plurality of guide rails by applying a relatively small torque thereto.

2. Description of the Prior Art

As an economical method of executing pile foundations, an under-reamed bore foundation is well known in which a larger diameter bore is excavated at the bottom of a straight pile bore to increase the end bearing capacity against a vertical load applied to the pile.

Conventionally, the method of reverse circulation drill excavation has been used for executing these under-reamed pile foundations. In this method, however, since the under-reamed bore is excavated by extending the extendable wing bits horizontally by hydraulic cylinders without moving the wing bits downward, it is very difficult to form a stable impermeable surface layer preventing water from penetrating into the soil wall of the excavated bore and preventing lumps of soil from being dislodged therefrom, and additionally a relatively great torque is required to excavate the under-reamed part of the bore.

A more detailed description of the prior-art under-reaming bore excavator will be made hereinafter under DETAILED DESCRIPTION OF THE INVENTION with reference to the attached drawings.

SUMMARY OF THE INVENTION

With these problems in mind therefore, it is the primary object of the present invention to provide an under-reaming pile bore excavator which can create a stable impermeable surface on the wall of the excavated under-reamed pile bore while excavating the under-reamed part of the bore by applying a relatively small torque thereto.

To achieve the above-mentioned object, the under-reaming pile bore excavator according to the present invention comprises a plurality of slidable wing bits movable downward along a plurality of guide rails and extendable outward to excavate the under-reamed part of the bore, in addition to a plurality of main drill bits to excavate the straight pile bore.

In the under-reaming pile bore excavator according to the present invention, a straight pile bore is first excavated by the main drill bits provided at the tip of the excavator with the slidable wing bits held at their uppermost position, and then the under-reamed part of the pile bore is excavated by moving the slidable wing bits downward and by extending them outward along the guide rails by the weight of masses mounted onto the slidable wing bits, with the main drill bits in position at the bottom of the pile bore.

BRIEF DESCRIPTION OF THE DRAWINGS

The features and advantages of the under-reaming pile bore excavator according to the present invention will be more clearly appreciated from the following description taken in conjunction with the accompanying drawings in which like reference numerals designate corresponding elements and in which.

DETAILED DESCRIPTION OF THE PREFERRED EMBODIMENTS

To facilitate understanding of the present invention, first of all, a brief reference will be made to a prior-art under-reamed bore excavator.

Figure 1A:
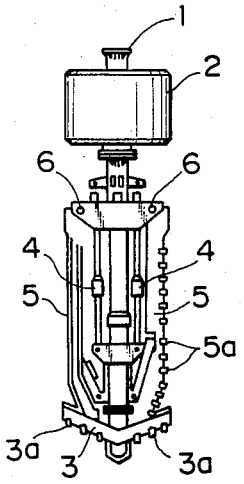
(Prior Art) FIG. 1A
FIG. 1(A) is a side view of a prior-art under-reaming pile bore excavator where the expandable wing bits are retracted inward.

Conventionally, the method of reverse circulation drill excavation is used to excavate an under-reamed pile bore. FIGS. 1(A) and (B) show a sample prior-art under-reamed bore excavator.

This excavator comprises a shaft 1, a stabilizer 2 connected to the shaft 1, a bit 3 provided at the tip of the shaft 1, extendable wing bits 5 extended in the radial direction by hydraulic cylinders 4. The bit 3 s provided with teeth 3*a* arranged to act vertically downward, and the extendable wing bits 5 are provided with teeth 5*a* arranged to act horizontally outward. The extendable wing bits 5 can extend or retract about pins 6 as their centers while rotating as shown in FIGS. 1(A) and (B).

Figures 2A, 2B, 2C:
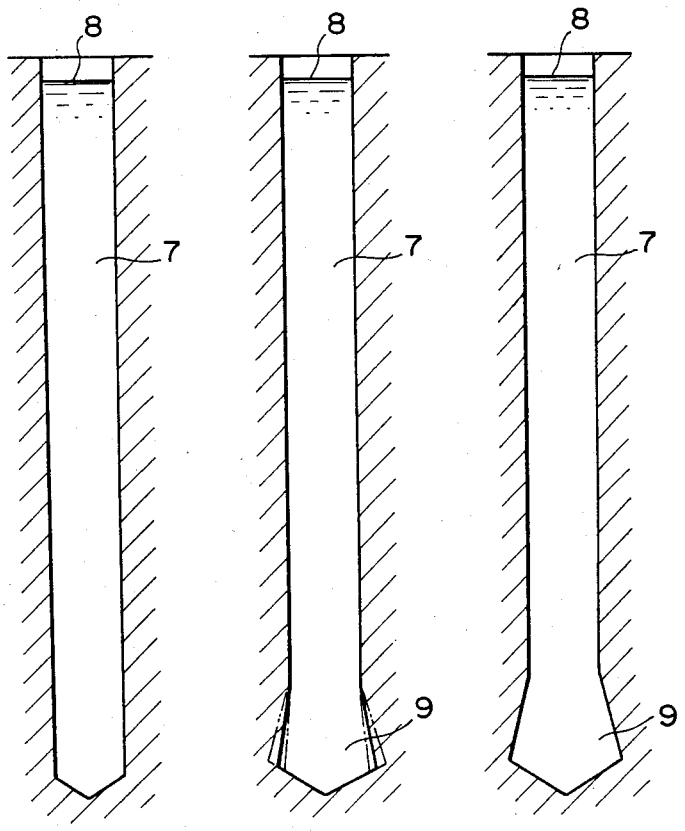
(Prior Art) FIG.2A FIG.2B FIG.2C
FIGS. 2(A), (B), and (C) are axial sectional views of an under-reamed pile bore, indicating the excavation processes of the prior-art excavator.

FIGS. 2(A), (B) and (C) depict the excavation steps based on the method of excavating an under-reamed pile bore according to the above-mentioned excavator.

First, a straight cylindrical pile bore 7 with a uniform diameter (for instance, 1700 mm in diameter) is excavated to a desired depth as shown in FIG. 2(A). While the straight cylindrical pile bore is being excavated, extendable bits 5 are retracted inward as shown in FIG. 1(A) and only bit 3 excavates the straight bore. In FIG. 2, reference numeral 8 denotes a liquid used to stabilize the soil surface of the excavated pile bore, such as bentonite slurry, which prevents water from penetrating the wall and lumps of soil from being dislodged therefrom.

Figure 1B:
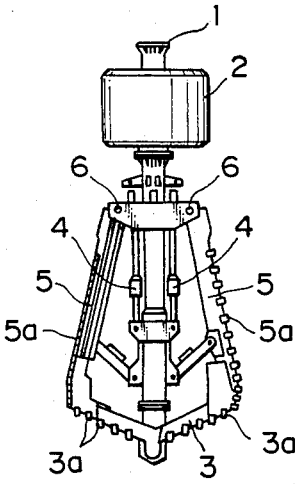
FIG. 1(B) is a side view of a prior-art under-reaming pile bore excavator where the expandable wing bits are extended outward.

Next, the wider bottom part 9 of the pile bore of FIG. 2(B) is gradually excavated, with the bit 3 in position at the bottom thereof, by the extendable wing bits 5 extending gradually by the force of the hydraulic cylinders 4 shown in FIG. 1(B) until the extendable bits 5 reach their predetermined angle while excavating the bore horizontally outward, so that the under-reamed pile bore can be excavated as shown in FIG. 2(C).

The typical dimensions of an under-reamed part of the pile bore are about 2700 mm in the under-reamed bore height and about 2400 mm in the maximum under-reamed bore diameter, in the case of a 1700 mm-dia. pile bore. However, it is of course possible to excavate a pile bore having greater or smaller dimensions than those described above.

The above-mentioned prior-art under-reaming bore excavator and the method of its excavation experiences several drawbacks, the basic problems are:

Since extendable wing bits 5 excavate the bore gradually outward by rotating at the same depth and not by excavating the bore downward in order to widen the diameter of the bottom of the bore, the soil surface is repeatedly excavated by teeth 5*a* of expandable wing bits 5 and the stable impermeable layers formed on the soil surface of the bore are taken off one after another. Therefore, it is difficult to form a stable impermeable layer of the bentonite slurry poured thereinto, throughout the soil surface excavated by the extendable wing bits 5. This stable impermeable layer is very important to prevent liquid from being lost into the soil surface and prevent soil from being dislodged from the surface of the excavated under-reamed bore.

As is well known, the feature of the reverse rotation method is to prevent lumps of soil from being dislodged from the wall surface of the excavated bore by forming a stable impermeable layer and by applying to this stable layer a static water pressure generated by raising the water level about two meters higher than the ordinary groundwater level. Therefore, without the layer and the increased static water pressure, it would be impossible to prevent soil from being dislodged. If soil is dislodged from the bore wall, it is impossible to form the desired uniform under-reamed pile bore to obtain a designed end-bearing capacity, poor reliability.

Next, in the prior-art under-reamed bore excavator, since extendable wing bits 5 excavate the bore horizontally at the same depth without moving downward, the overall length of the extendable wing bits is designed to be equal to the height of excavated under-reamed bore, and, since the extendable wing bits excavate the whole wall surface horizontally at the same time, a very wide extendable wing bit and a very large torque to rotate the bit is inevitably required.

Figure 3:
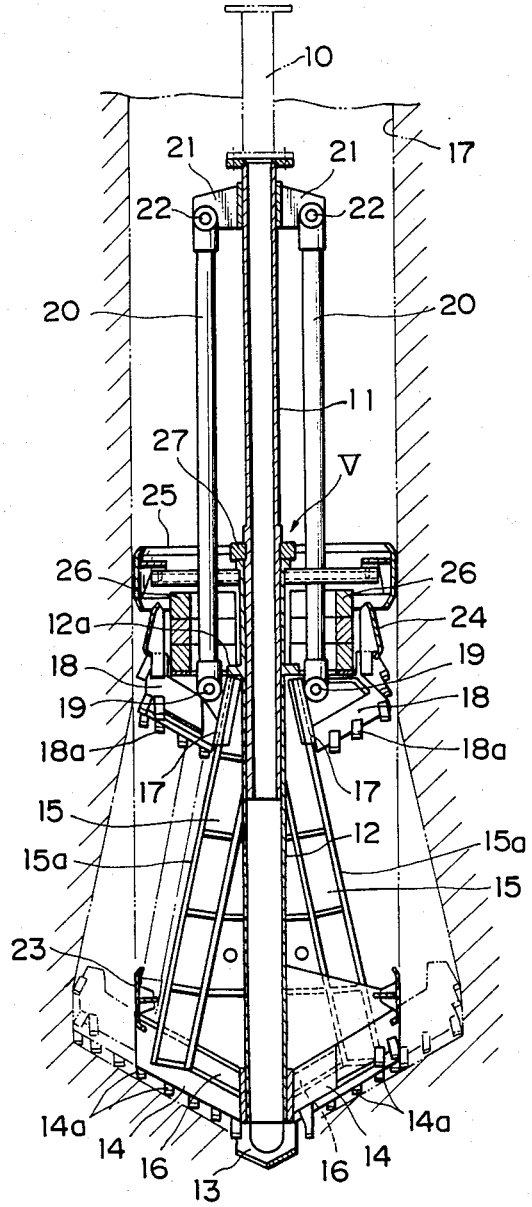
FIG. 3 is an axial sectional view of an under-reaming pile bore excavator of a first embodiment according to the present invention.
Figure 4:
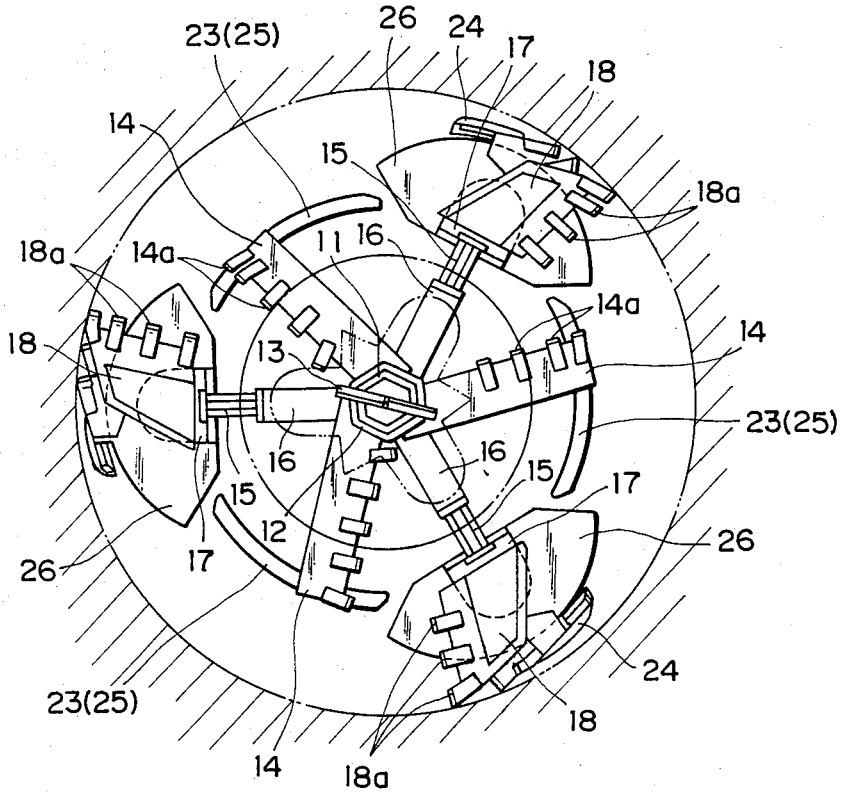
FIG. 4 is a bottom view of an under-reaming pile bore excavator of a first embodiment according to the present invention.

In view of the above description, reference is now made to FIGS. 3 to 13, and more specifically to FIGS. 3 and 4, in which a first embodiment of the under-reaming bore excavator according to the present invention is illustrated. Reference numeral 10 denotes a drill pipe to which rotation and thrust are both supplied by drawworks at ground-level. An inner pipe 11 is connected to the bottom of drill pipe 10. Although inner pipe 11 is depicted as a hexagonal pipe in FIG. 6, since this pipe is used to rotate an outer pipe 12, described hereinbelow, in which it can slide telescopically, it is possible to use a pipe with a key, or a splined shaft and so on, without being limited to the hexagonal pipe shown in FIG. 6.

An outer pipe 12 is connected to the outer surface of the inner pipe 11.

In this embodiment, a hexagonal pipe is used to match it with the shape of hexagonal inner pipe 11. Inner pipe 11 and outer pipe 12 define a rotating drill shaft which can rotate while extending telescopically.

To the bottom end of outer pipe 12, a fishtail shaped edge 13 is attached facing downward, enabling excavated soil mixed with water to be collected and pumped up to ground-level through pipes 10, 11, and 12.

To the bottom end of outer pipe 12, three main drill bits 14 are arranged at angular intervals of 120 degrees extending in the radial direction of the pipe and having an upward bit angle, as depicted in FIG. 3. A plurality of cutter teeth 14*a* are provided on the ends of bits 14 and projecting clockwise (seen from the top thereof) and downward.

In addition, mid-way between each pair of main bits 14 arranged at angular intervals of 120 degrees, three I-shaped guide rails 15 are disposed to extend downward and outward with the same angle of inclination as the desired taper angle 9*a* of under-reamed bore 9 (about 11–12 degrees), the upper ends of which are fixed by welding to flange 12*a* of outer pipe 12, and the lower ends of which are also fixed by welding to support bars 16 fixed near the lower end of the outer pipe.

Three independent slidable members 17 are respectively mounted to external flanges 15*a* of guide rails 15. Three slidable wing drill bits 18 are respectively mounted to members 17, and are separately arranged to extend in the radial direction of outer pipe 12 and have the same upward angle of inclination as that of the main bit 14. On their respective slidable wing bits 18, a plurality of cutter teeth 18*a* are arranged in the direction opposite to those of the main bit 14, that is, projecting counterclockwise (see from the top thereof) and downward.

Slidable members 17 are rotatably connected to support rods 20 by pins 19. The top of the respective support rods 20 are also rotatably connected to a bracket 21 fixed to the top of inner pipe 11 with pins 22.

As shown in FIG. 3, a first main stabilizer 23 is disposed behind main bit 14 (over the main bit) at a position equal to the diameter of straight bore 7 to be excavated.

A second slidable stabilizer 24 is disposed behind slidable wing bit 18 with the same angle of inclination as that of guide rails 15. A third main stabilizer 25 is disposed over wing bits 18 and has the same diameter as that of the straight pile bore with inner pipe 11 as its center. Stabilizers 23–25 are used to form a stable impermeable soil surface on the excavated bore, when brought into contact therewith.

A weight 26 is provided to increase thrust and is mounted over slidable wing bits 18. A two-piece stopper ring 27 is provided to stop the upward movement of outer pipe 12 (or the downward movement of inner pipe 11) beyond the position shown in FIG. 5. Stopper ring 27 is removably fitted in a groove 11*a* provided at a desired position on the inner pipe 11 so that upper flange 12*b* of outer pipe 12 is brought into contact with the stopper ring to limit the mutual movement of these two pipes 11 and 12.

There is described hereinbelow the method of using the under-reaming bore excavator according to the present invention.

Figure 5:
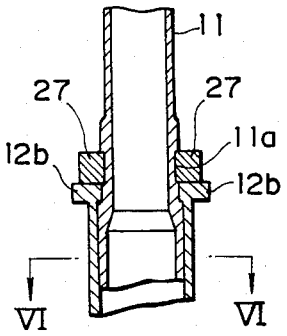
FIG. 5 is a fragmentary enlarged vertical sectional view of the part V shown in FIG. 3.
Figure 6:
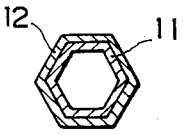
FIG. 6 is an expanded sectional view taken along the lines VI—VI of FIG. 5.
Figure 7:
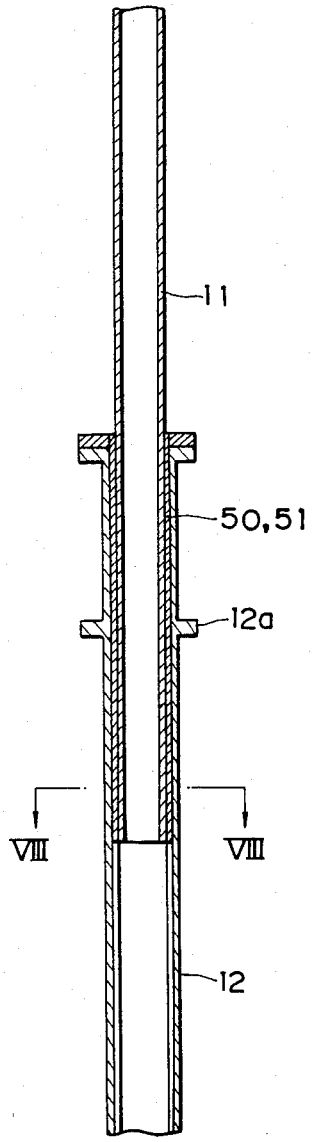
FIG. 7 is a fragmentary axial sectional view of the inner pipe and the outer pipe, and keys and key-ways of a second embodiment of an under-reaming pile bore excavator according to the present invention.

First, stopper ring 27 is fitted in groove 11*a* of inner pipe 11, as shown in FIG. 5. Slidable bits 18 are lifted to their uppermost position of (FIG. 3), and outer pipe 12 is lifted to its uppermost position so that slidable member 17 is brought into contact with flange 12*a* of outer pipe 12 and the top end of the outer pipe is brought into contact with stopper ring 27.

Drill pipe 10 is supported firmly by draw-works at ground-level. Drill pipe 10 is rotated to excavate straight pile bore 7 to a given depth, as shown in FIG. 12(A).

Next, the whole drill string is raised to ground-level to effect removal of stopper ring 27 so that inner pipe 11 can move downward and slide telescopically in outer pipe 12, thus enabling slidable wing bits 18 to also move downward.

The whole string is then lowered into pile bore 7 until main bits 14 reach the bottom thereof. In this case, slidable wing bits 18 depend from the inner pipe 11 through rods 20 and main bits 14 depend from the slidable wing bits since flange 12*a* of outer pipe 12 is brought into contact with slidable member 17.

Figures 12A, 12B, 12C:
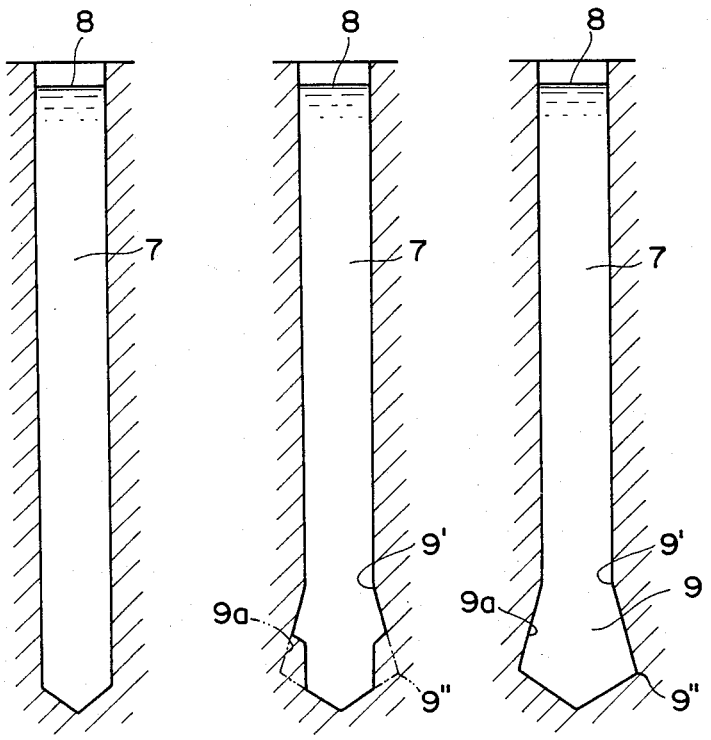
FIGS. 12(A), (B) and (C) are axial sectional views of an under-reamed pile bore, indicating the excavation processes of the excavator according to the present invention.

Next, slidable wing bits 18 are rotated by the draw-works at ground-level, and move slowly down guide rails 15 while widening the diameter of the pile bore from the upper part 9' to the lower part 9'' of the under reamed pile bore, as shown in FIGS. 12(B) and (C). This time, slidable wing bits 18 are rotated in the direction of excavation of under-reamed bore (counterclockwise in the figures when seen from the top thereof) under thrust provided by weight 26. In this step main bits 14 do not excavate the bore and are maintained at their previous position within the pile bore; only slidable wing bits 18 excavate the under-reamed bore by descending guide rails 15.

Figure 13:
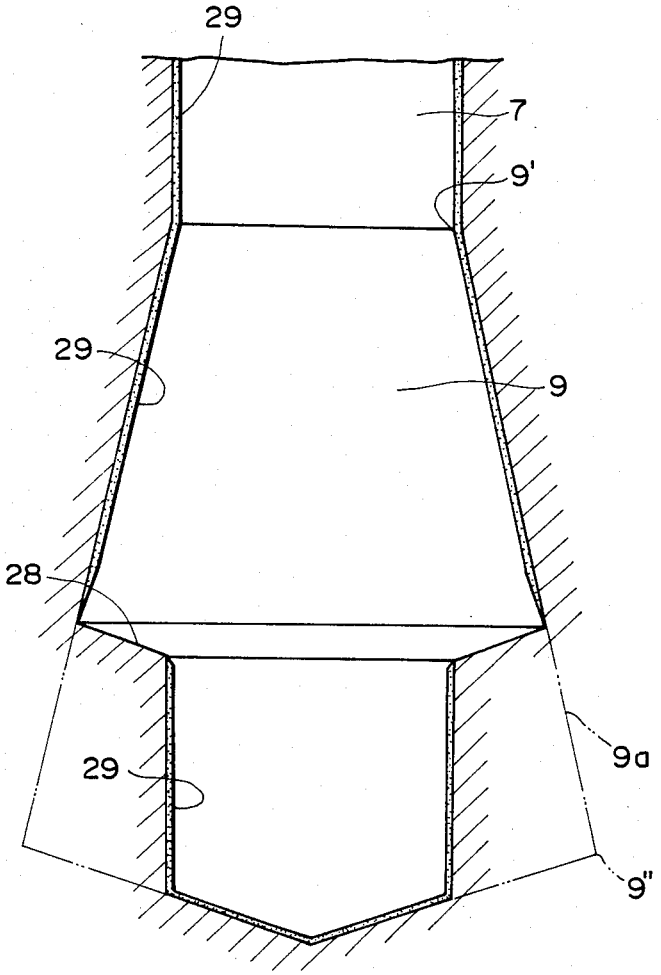
FIG. 13 is an expanded axial sectional view of the under-reamed pile bore of FIG. 12, indicating the process of forming the under-reamed part of the bore.

Since excavation with slidable wing bits 18 is performed along guide rails 15 which have the same angle of inclination as tapered diameter 9*a* of under-reamed pile bore 9, as depicted in FIGS. 12 and 13, it is possible to excavate the under-reamed bore using a relatively small torque by cutting the excavation surface 28 gradually down from the upper position 9' to the lower position 9''.

Since cutter teeth 18*a* of the slidable wing bits 18 excavate the under-reamed part of the bore downwards, it is possible to prevent lumps of soil from being dislodged from the wall surface of the excavated bore, resulting in formation of a stable impermeable soil surface thereon. Additionally, a stable layer 29 is formed by stabilizer 24 on the wall surface of under-reamed pile bore 9 which has already been excavated by the slidable wing bit 18, as shown in FIG. 13, so that it is possible to further prevent lumps of soil from being dislodged from the soil surface of the stabilized bore. When slidable wing bits 18 reach their lowermost position (the position shown by dot-dot-dashed lines in FIG. 3), excavation of under-reamed bore 9 is complete and the bore as shown in FIG. 12*c* is formed.

The whole string is then raised to ground-level by the draw-works there. First, inner pipe 11 connected to drill pipe 10 is raised, lifting slidable members 17 via support rods 20 connected to brackets 21 (attached to inner pipe 11) so that member 17 upward along guide rails 15. Slidable wing bits 18 are returned to their original position, however, main bits 14 still remain on the bottom of the excavated bore. When slidable members 17 reach their uppermost position and are brought into contact with flange 12*a* of outer pipe 12, main bits 14 are lifted together with outer pipe 12 since the main bits are fixed thereto.

Accordingly, it is possible to raise the whole excavator to the ground in the state shown by solid lines in FIG. 3.

In these excavators, the excavated soil is mixed by the rotational force with water poured into the pile bore and is pumped up to ground level through the fish-tail edge 13, the inner and outer pipes 11 and 12 and the drill pipe 10.

In the first embodiment, the drill shaft is made up of inner pipe 11 and outer pipe 12, and both pipes are telescopically connected with using keys and key grooves parallel to the axis thereof or hexagonal pipes to transmit the torque. However, since the torque transmitted from inner pipe 11 to outer pipe 12 while the slidable wing bit is moving downward is relatively high, a large frictional force is generated between the keys and the grooves and therefore it is sometimes difficult for the slidable wing bits to slide downward smoothly and quickly, and further it is sometimes difficult to form an under-reamed pile bore accurately and efficiently.

To overcome these problems, a second embodiment of the under-reamed pile bore excavator according to the present invention comprises an inner pipe 11 wherein a pair of skew rectangular keys are fixed on the outer surface thereof. Outer pipe 12 includes a pair of skew rectangular members with a corner cutout fixed on the inner surface thereof, forming a key-way in cooperation with the skew rectangular keys so that a downward force is generated above the friction force between inner pipe 11 and outer pipe 12 so as to move the slidable wing bits downward and outward along guide rails 15 smoothly.

Referring to FIGS. 7–11, there is explained a second embodiment of the under-reamed pile bore excavator according to the present invention.

Figure 8A:
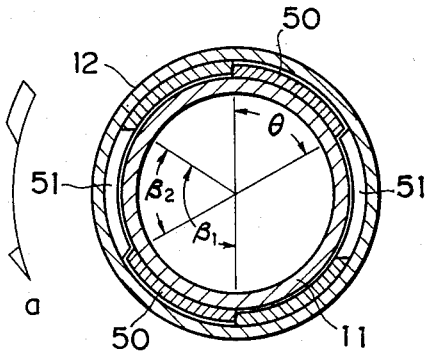
FIGS. 8(A) and (B) are expanded cross-sectional views taken along the lines VIII—VIII of FIG. 7.

In this embodiment, two keys 50 with an arc angle of $\theta$ are provided symmetrically and axially on the outer surface of the inner pipe 11 concentrically thereto, as depicted in FIGS. 8(A) and (B), and 9. Similarly, two key-ways 51 with an arc angle of $\beta_1$ which is about twice the arc angle $\theta$ of the keys 50 for the upper half and with an arc angle of $\beta_2$ which is almost the same as the arc angle $\theta$ of the keys 50 for the lower half are formed symmetrically and axially on the inner surface of the outer pipe 12 by two skew rectangular members 52.

Figure 10:
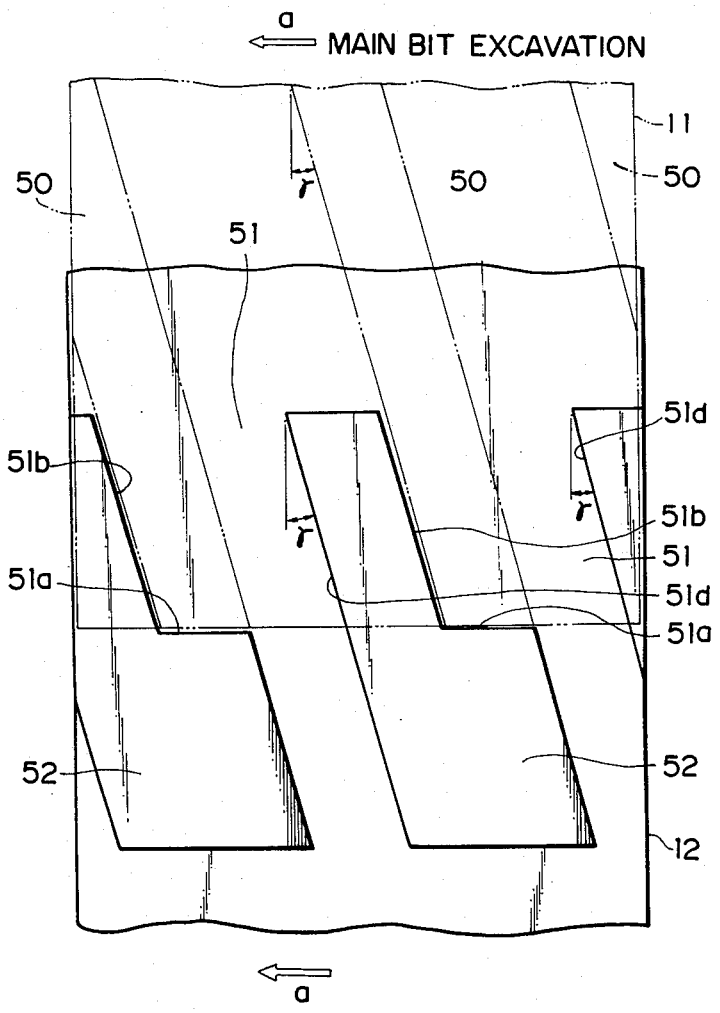
FIG. 10 is an opened-out view of the outer pipe of FIG. 9, representing the relationship between the keys and the key-ways of the second embodiment according to the present invention when the excavator is rotated in the direction of main bit excavation.
Figure 11:
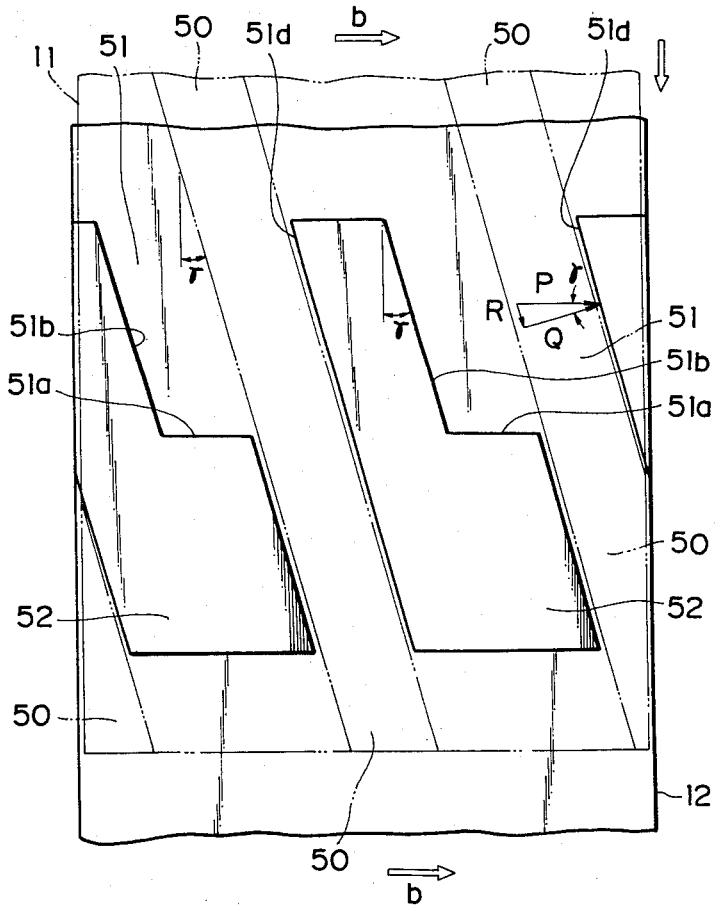
FIG. 11 is an opened out view of the outer pipe of FIG. 9, representing the relationships between the keys and the key-ways of the second embodiment according to the present invention when the excavator is rotated in the direction of slidable bit excavation.

FIGS. 10 and 11 show opened-out views representing the relationship between the keys 50 and the key-ways 51. In these figures, the dotted lines indicate the inner pipe 11 and the keys 50 provided on the outside thereof, and the solid lines indicate the outer pipe 12 and the key-ways 51. The key-ways 51 are wider over the horizontal stops 51*a* provided at about the middle thereof and are narrow below the horizontal stops 51*a*. Both the keys 50 and the key-ways 51 are designed so as to have a common skew angle of $\gamma$ (11°–13°) with respect to the axial direction of the inner and outer pipes 11 and 12.

This skew angle $\gamma$ can be obtained easily by using the following simple expressions, so that a downward force may be generated by the frictional force produced between the keys 50 and the key-way members 52 while torque is being transmitted from the inner pipe to the outer pipe:

$$R=\mu Q,$$

that is, $\mu=R/Q=\tan\gamma$ where Q is the normal component of the rotation force P, R is the tangential component, and $\mu$ is the coefficient of friction.

Since the keys 50 and the key-ways 51 are arranged as described hereinabove, when the inner pipe 11 is rotated in the normal direction (clockwise when seen from the top thereof) to excavate the straight bore using the main bits 14 as is shown by the arrows a in FIG. 8(A) and FIG. 10, the lower ends of the keys 50 are engaged with the sloped sides 51*b* of the key-way members 52 with the lower ends of the key 50 brought into contact with the stops 51*a* of the key-way members 52 in order to transmit torque to the outer pipe 12 to rotate the main bits in the same direction.

In this case, since the keys 50 fixed to the inner pipe are brought into contact with the stops of the key-way members 52, even when the main bits fixed to the outer pipe are rotated to excavate the straight bore, the slidable wing bits fixed to the inner pipe will not be lowered to excavate the under-reamed part of the bore.

Figure 8B:
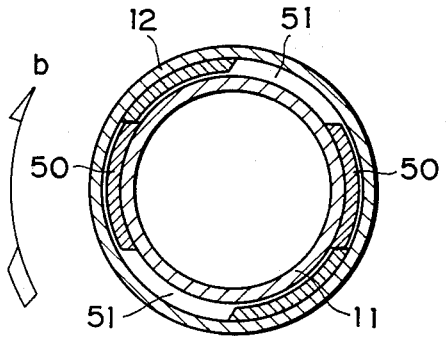
Figure 9:
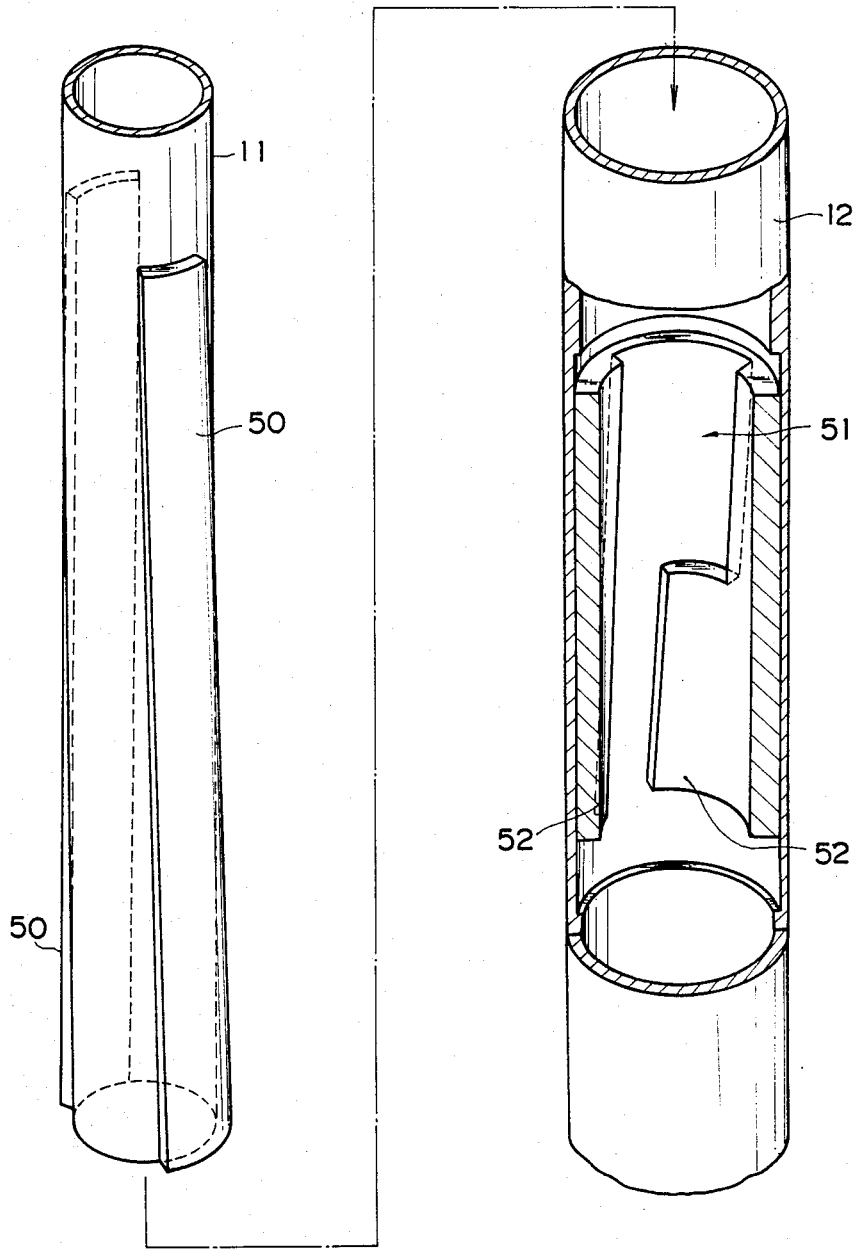
FIG. 9 is an exploded perspective view of the inner pipe and a broken perspective view of the outer pipe of the second embodiment according to the present invention.

On the other hand, when the inner pipe 11 is rotated in the opposite direction thereto (when the slidable wing bits are excavating the under-reamed bore) as is shown by the arrows b in FIG. 8(B) and FIG. 11, the lower ends of the keys 50 are disengaged from the sloped sides 51*b* of the key ways 51, the lower ends of the keys 50 are moved away from the stops 51*a* of the key-way members 52, and are engaged with the sloped sides 51*d* of the key-ways 51.

In this embodiment, since the keys 50 fixed to the inner pipe are kept away from the stops of the key-way members, the slidable wing bits fixed to the inner pipe can freely lower to excavate the under-reamed bore. In this case, since the keys are not straight having a skew angle $\gamma$, a downward force R as is shown in FIG. 11 is generated as the tangential component of the contact force between the keys and the key-way members, so that the frictional force generated therebetween is canceled by this downward force R.

Now, there is described hereinbelow the method of using the under-reamed bore excavator of the second embodiment according to the present invention.

First, the method of excavating a straight pile bore is explained. The inner pipe 11 is raised in order to place the keys 50 onto the stops 51*a* of the key-way members 52. The drill pipe 10 is rotated in the normal direction shown by the arrow a in FIG. 8(A) or FIG. 10 in order to rotate the main bits to excavate the straight pile bore 19 while applying an appropriate thrust downward.

Next, the method of excavating the under-reamed part of the bore is explained. After a straight pile bore of a desired depth has been excavated, the rotation of the drill pipe is stopped. With the main bits 14 in position at the bottom of the straight bore, the drill pipe 10 is rotated in the opposite direction thereto as shown by the arrow b in FIG. 3(A) and FIG. 11. In this case, since the keys 50 of the inner pipe 11 are kept away from the stops 51*a* of the key-way members 51 and are brought into contact with the sides 51*d* of the key-way members, the keys 50 can freely move down the key-ways 51, so that the slidable wing bits fixed to the inner pipe 11 can freely move down the guide rails 15 to excavate the under-reamed bore.

In this case, although a frictional force is generated between the keys and the key-way members, since this frictional force is canceled by the downward component of the contact pressure therebetween because of the skew angle of $\gamma$ as described already, the slidable wing bits can smoothly move down to the bottom of the under-reamed bore.

Lastly, the method of lifting the excavator is explained. After the under-reamed bore has been completely excavated, the pipe 10 is raised with it rotating in either direction. In this case, the inner pipe 11 first comes up together with the slidable wing bits 18 with the outer pipe 12 remaining at the bottom thereof. The external diameter of the slidable wing bits contracts when rising along the guide rails 15 and the slidable wing bits are stopped when brought into contact with the stopper 12*a*. After that, the slidable wing bits 18 and the main bits 14 are both raised to ground-level together.

As described above, since the tapered guides are provided so as to expand outward and downward, and the slidable wing bits with their cutters facing downward are lowered along the guide rails while excavating and forming an under-reamed pile bore, it is possible to form the essential stable impermeable soil layer on the wall of the excavated bore, to prevent lumps of soil from being dislodged from the wall surface of the pile bore, and to excavate the under-reamed pile bore by using a relatively small torque.

Further, since the straight pile bore is excavated by the main bits by rotating them in one direction and the under-reamed bore is excavated by the slidable wing bits by rotating them in the opposite direction thereto, and since the keys and the key-ways provided between the inner pipe and the outer pipe are arranged at a skew angle, it is possible to slide the slidable wing bits downward smoothly and quickly, thus an accurately under-reamed pile bore can be excavated efficiently by a relatively simple method of excavation.

It will be understood by those skilled in the art that the foregoing description is in terms of preferred embodiments of the present invention wherein various changes and modifications may be made without departing from the spirit and scope of the invention, as is set forth in the appended claims.

What is claimed is:

1. A method of excavating an under-reamed pile bore, comprising the steps of:

(a) excavating a straight pile bore to a given depth by rotating a main drill bit in a first direction while applying downward thrust to said main drill bit;

(b) excavating an under-reamed pile bore by rotating a plurality of slidable wing bits in a direction opposite the first direction so that said slidable bits move both downward and outward into progressively large cutting diameter position during rotation thereof to thereby excavate said under-reamed bore; and (c) stabilizing soil walls of said under-reamed pile bore by means of a stabilizer slidably disposed above said wing bits to progressively contact said under-reamed bore walls following formation thereof by cutting action of the wing bits to thereby produce soil walls having stable impermeable surfaces.

2. A method of excavating a straight pile bore and an under-reamed pile bore with an excavator comprising a drill string having an upper pipe and a lower pipe telescopically connected together, a main drill bit connected to a lower end of the lower pipe, and slidable wing bits slidably connected to the upper pipe for simultaneous downward and outward movement along guide means attached to the drill string, comprising the steps of:

(a) excavating a straight bore with said main drill bit by rotating said upper and lower drill string pipes under thrust in an extended, locked position to a predetermined depth;

(b) raising said drill string to unlock the upper and lower pipes so that the upper pipe can slide telescopically within the lower pipe;

(c) lowering the drill string into the pile bore until said main bit contacts the bottom; and (d) excavating said under-reamed pile bore by causing said upper pipe to descend into the lower pipe while rotating said wing bits downwardly and outwardly by means of draw-works located at ground level transmitting a rotating and downwardly applied thrust force to said wing bits through said upper pipe.

3. The method of claim 2, comprising the further step of stabilizing the soil wall of the under-reamed pile bore with stabilizer means disposed above said wing bits.

* * * * *